US006851490B2

(12) United States Patent
Cherrington

(10) Patent No.: US 6,851,490 B2
(45) Date of Patent: Feb. 8, 2005

(54) APPARATUS AND PROCESS FOR DRILLING CASING WITH ENVIRONMENTALLY CONTAINED MUD ANNULUS

(76) Inventor: Martin Cherrington, 8600 Emperor Dr., Fair Oaks, CA (US) 95628

( * ) Notice: Subject to any disclaimer, the term of this patent is extended or adjusted under 35 U.S.C. 154(b) by 9 days.

(21) Appl. No.: 10/461,658

(22) Filed: Jun. 12, 2003

(65) Prior Publication Data

US 2003/0230432 A1 Dec. 18, 2003

Related U.S. Application Data

(60) Provisional application No. 60/388,732, filed on Jun. 14, 2002.

(51) Int. Cl.[7] ..... E21B 7/04

(52) U.S. Cl. ..... 175/61; 175/171; 175/26

(58) Field of Search ..... 175/61, 73, 62, 175/26, 38, 171, 170, 92

(56) References Cited

U.S. PATENT DOCUMENTS 3,575,245 A * 4/1971 Cordary et al. ..... 175/268
3,655,001 A * 4/1972 Hoffman ..... 175/213
3,894,402 A 7/1975 Cherrington
4,121,673 A 10/1978 Cherrington
4,221,503 A 9/1980 Cherrington
4,679,637 A * 7/1987 Cherrington et al. ..... 175/61
4,711,310 A * 12/1987 Luen ..... 175/171
6,722,451 B2 * 4/2004 Saugier ..... 175/57

OTHER PUBLICATIONS

Ives,. 30–Inch Line Bored Under Green's Bayou is "On Target", Pipeline & Gas Journal 205:3: 40–42 (1978).

* cited by examiner

*Primary Examiner*—Frank Tsay
(74) *Attorney, Agent, or Firm*—William Michael Hynes; Townsend and Towsend and Crew LLP

(57) ABSTRACT

A large diameter bore—in the range of 30 inches or more—is made through a geologic formation, such as the active surf zone and into the maritime zone. The drill head is provided with a mud powered motor (typically of the Moyno variety) which drives a hydraulic pump connected to a plurality of closed loop hydraulic circuits remotely controlled through electrical connection along the large diameter bore. One hydraulic circuit powers the rotating drill head; a second hydraulic circuit powers a mud and tailings evacuation pump; and a third hydraulic circuit articulates the drill head to provide direction. Mud exhausted from the mud motor is exhausted to the cutting head of the drill and evacuated along with dislodged cuttings through a pump in the drill head. The pump is individually controlled to pump at a rate, which assures a slight negative pressure in the required annulus about the drilled conduit, thus assuring that any leakage is from the surrounding soil into the annulus.

6 Claims, 8 Drawing Sheets

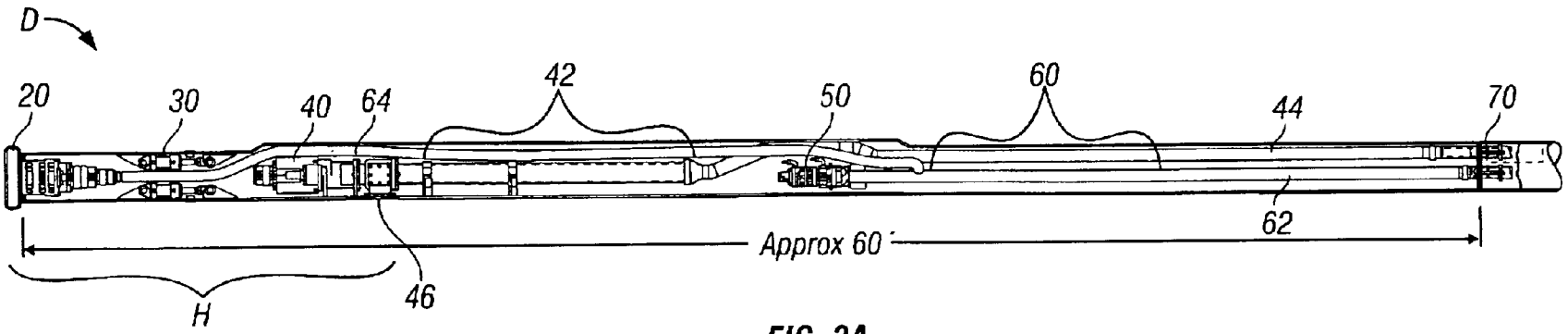
FIG. 3A
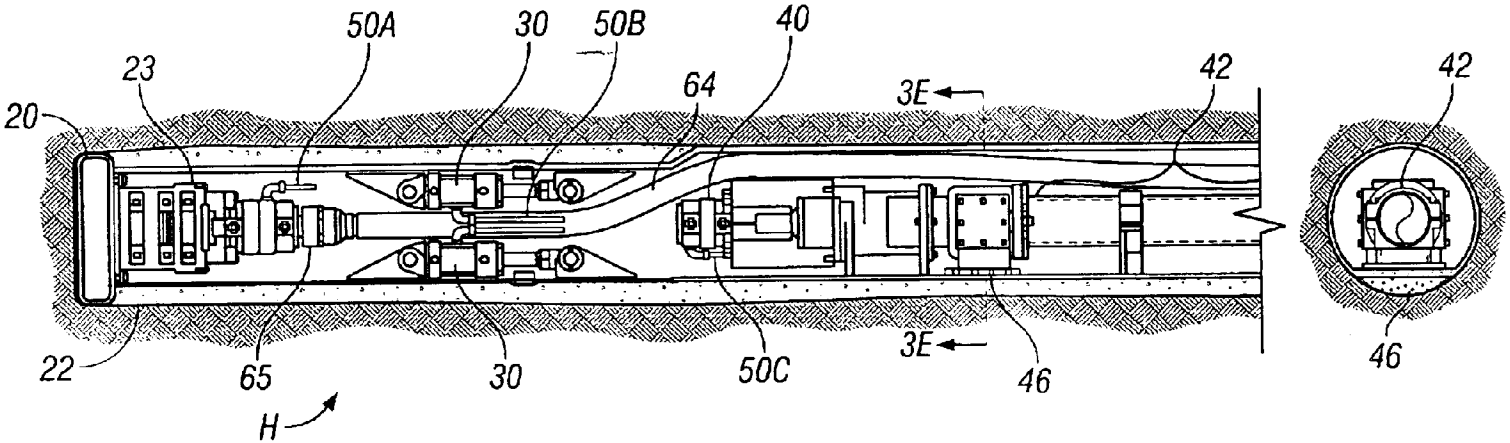
FIG. 3B
FIG. 3E

APPARATUS AND PROCESS FOR DRILLING CASING WITH ENVIRONMENTALLY CONTAINED MUD ANNULUS

CROSS-REFERENCES TO RELATED APPLICATIONS

This application claims priority from my Provisional Application Ser. No. 60/388,732 filed Jun. 14, 2002 entitled Apparatus and Process for Drilling Casing with Environmentally Contained Mud Annulus.

STATEMENT AS TO RIGHTS TO INVENTIONS MADE UNDER FEDERALLY SPONSORED RESEARCH AND DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

This invention relates to drilling underground through fractured geologic zones or drilling pipes for relatively long distances. In such drilling, the pressure required for drilling can exceed the ability of the ambient formation to contain and prevent the escape of drilling fluids. One example of such fractured geologic zones it is from shore to beyond the surf in maritime zones, typically from the shore into the ocean bottom. Another example is drilling over long distances where conventional drilling technology would require use of pressures that exceed the ability of the ambient geologic formation to contain fluid in the annulus around the drilled pipe.

More particularly, a drilling method and apparatus is disclosed which produces a large bore from dry land on the shore, through the fractured geological zone or long distance without leakage.

BACKGROUND OF THE INVENTION

Drilling invert arcuate paths beneath obstacles such as rivers and ocean inlets or bays and bayous is known. Representative of such drilling are the disclosures of my earlier patents entitled Apparatus and Method for Emplacing a Conduit Along An Underground Arcuate Path U.S. Pat. No. 3,894,402 issued Jul. 15, 1975; Drilling and Installation System U.S. Pat. No. 4,121,673 issued Oct. 24, 1978; and, Drilling Method and Apparatus for Large Diameter Pipe U.S. Pat. No. 4,221,503. Additionally, the readers attention is directed to the Article 30-Inch Line Bored Under Green's Bayou is "On Target" from the March, 1978 Pipeline & Gas Journal. The disclosures of these documents is incorporated by reference herein as if set forth in full.

Summarizing the state of the art evidenced by these publications, a pre-bent large diameter pipe was inserted along an invert arcuate path under a water body, such as a bayou. A hydraulic powered drill head had a separate drilling rig connected hydraulic circuit to power the drill head. Similarly, a plurality of separate drill rig connected hydraulic circuits were used to articulate the drill head with respect to the pipe; typically one circuit was required for each degree of movement of the drill head. Additionally, a separate hydraulic circuit was used to drive a mud evacuation pump to evacuate under pressure cuttings from the drill head to the pipe entry point. Finally, a pressurized annulus was required about the large diameter casing. In the case of Green's Bayou, this annulus was provided with a special (and expensive) pressurized mud mixture that both "floated" the installed conduit and provided the require lubricity necessary for casing installation.

In the case of Green's bayou, it should be noted, that the pressure on the annulus was in excess of ambient fluid pressure on the path along which the drilled conduit was disposed. Drilling was from ground level on one side of the bayou to ground level on the opposite side of the Bayou.

Modern Problems Encountered

Of recent date, drilling has been required to enter the ocean. Where fiber optic cables are being laid, drilling through and out beyond the surf zone has been required. Otherwise, the action of the surf and sand rapidly abrades away the conventional armor placed around fiber optic cables.

Once one is beyond the surf zone, an area of the ocean is entered that can be called the maritime zone. In the maritime zone, ground tackle from ships such as chains and anchors are hazards to the installed cable. The most expedient solution is to trench cable to a depth of several meters through such maritime zones.

In the usual case, for each fiber optic cable laid, a separate conduit is drilled. The separate drilled conduit provides a protective barrier against the conventional abrasion in the surf zone. Once the cable is out beyond the surf zone, trenching techniques are used to bury the cable through the maritime zone. Thereafter, cable is conventionally laid on the ocean bottom surface.

Often, a single entry point is utilized for cables headed to many destinations. By way of example, optical fibers entering through a single pit ashore can individually be destined for widely differing destinations. A single shore entry point on the Pacific Coast of the United States could serve to accommodate optical cables destined for Hawaii, China, Formosa, Japan, Indonesia, and the like. The result, when viewed in plan, is a fan like array of individual drill strings originating at a common point on shore and extending out into the ocean beyond the surf zone and into the maritime zone. Thereafter, trenching of the cables occurs through the maritime zone.

The "trenching" of installed cable from the end of such drilled conduits is known. In such trenching techniques, a diver removes the drill head from the single drilled pipe. An optical fiber cable is then threaded to the conduit end. Thereafter, cable is laid using an under ocean bottom trenching apparatus. Such trenching apparatus buries cable in the ocean floor up to a depth of several meters. When the cable is conventionally buried, nautical ground tackle—such as anchors and their attached chains—have a reduced chance of harming the installed cable.

Of late, environmental concerns have effected such drilling through surf zones. Specifically, drilling mud leaking from the drilled annulus around the drilled pipe or "string" into the ocean environment has become a concern. It is believed that conventional drilling utilizing drilling mud constitutes an environmental hazard in the ocean in the ecologically sensitive surf and maritime zones.

Contributing to this environmental concern is the typical formation geology encountered along such surf and maritime zones. Since these zones are in the usual case active sites for wave—induced erosion and land—sea shore geologic activity, the formations are frequently fractured. These fractures provide paths along which drilling mud can escape.

Another environmental concern is where large diameter pipes are drilled underneath a water body for relatively long distances. When drilling long distances, the ambient pressure in drilling mud required for powering the drilling apparatus at the leading edge of the pipe being placed exceeds both the hydrostatic pressure and the ability of the geologic formation to resist leakage. In such cases, drilling mud can escape into the water body producing significant pollution.

In the usual drilling operation, drilling mud is introduced under some pressure at the drill head and channeled by conduit to the cutting bit at the leading end of the drill. The cutting bit is usually powered. For example, a mud powered Moyno motor can be used to drive a cutting bit.

When cutting occurs, mud and drill tailings escape along an annulus between the outside of the drilled casing and the soil surrounding the bore. The path of the mud in the annulus is from the cutting head of the drill bit back to the on-shore entry pit where initial introduction of the drill string occurred. In order to assure evacuation of the drilling mud and cuttings, pressure is applied to the transporting drilling mud flowing from the drill head to the entry pit. In order to assure mudflow, this pressure can exceed the ambient hydrostatic pressure of the ocean and surrounding soil and ocean water. The pressure required to assure mudflow is in large measure a function of the distance the mud must travel in the annulus about the pipe and in the geologic formation.

Remembering that the drill string is traversing eroded and geologically active zones, paths are present for drilling mud under pressure to escape. As a result, drilling mud frequently leaks into the ocean from the annulus surrounding such individually drilled conduits. Alternately, the pressure of the mud can exceed the ability of the formation and hydrostatic pressure to contain the mud. Leakage into the ambient body of water above the drilling can result. Lakes and rivers can be polluted.

In what follows, I introduce a concept for solving the above-enumerated problems. In so far as the prior art has not specifically enumerated the problems set forth above, invention is claimed. It goes without saying that recognition of the problem to be solved can constitute invention.

BRIEF SUMMARY OF THE INVENTION

A large diameter bore—in the range of 30 inches or more—is made through a geologic formation, such as the active surf zone and into the maritime zone. The drill head is provided with a mud powered motor (typically of the Moyno variety) which drives a hydraulic pump connected to a plurality of closed loop hydraulic circuits remotely controlled through electrical connection along the large diameter bore. One hydraulic circuit powers the rotating drill head; a second hydraulic circuit powers a mud and tailings evacuation pump; and a third hydraulic circuit articulates the drill head to provide direction. Mud exhausted from the mud motor is exhausted to the cutting head of the drill and evacuated along with dislodged cuttings through a pump in the drill head. The pump is individually controlled to pump at a rate, which assures a slight negative pressure in the required annulus about the drilled conduit, thus assuring that any leakage is from the surrounding soil into the annulus.

In the case of placement of the large diameter pipe underneath a body of water such as a lake, river, or bayou, the pressure can be controlled in the vicinity of the drill head not to exceed either the ambient hydrostatic pressure at the drill head and/or the ability of the geologic formation to prevent polluting leakage into the overlying body of water.

In the case of the placement of the large diameter pipe underneath thus surf zone, the large conduit extends from the shore, typically through the active surf zone to a point of drill exposure in the maritime zone. Thereafter, divers remove the drill head. Upon removal of the drill head, individual casings for corresponding individual optical fibers are installed in the large underground casing. For example seven individual small 5-inch conduits can be threaded in a typical 30-inch large diameter casing. Then, individual fibers are trenched from each small conduit in a fan type array out through the maritime zone. Once beyond, the maritime zone, conventional cable placement occurs.

BRIEF DESCRIPTION OF THE DRAWINGS

FIG. 3A is a side elevation section illustrating the drilling head and showing in particular the introduction of drilling mud to the mud powered motor, the hydraulic pump driven by the mud powered motor, the electrically controlled manifold for controlling the mud evacuation pump, drill head rotation, and directional drill articulation;

FIGS. 3B to 3E are respective side elevation sections of the respective lead, middle and trailing drill head sections of the drill head of FIG. 3A wherein:

FIG. 3B illustrates the lead one third of the drill head illustrating respectively the drill bit, the hydraulic motor driving the drill bit, the electronically controlled steering jacks, the hydraulic motor for powering mud evacuation, and the connected fluid return pump;

FIG. 3C illustrates the Moyno motor for extracting hydraulic power from the supplied mud and the exhaust of the mud to the drill bit for the entrainment drill bit cuttings in the exhausted mud;

FIG. 3D illustrates the mud supply line and the mud evacuation line; and

FIG. 3E is a section taken along lines 3E—3E of FIG. 3B illustrating the extraction of exhaust mud and entrained tailings from an annulus immediately around the drill head to evacuation by an internal conduit run to the shore;

DETAILED DESCRIPTION OF THE INVENTION

Figure 1A:
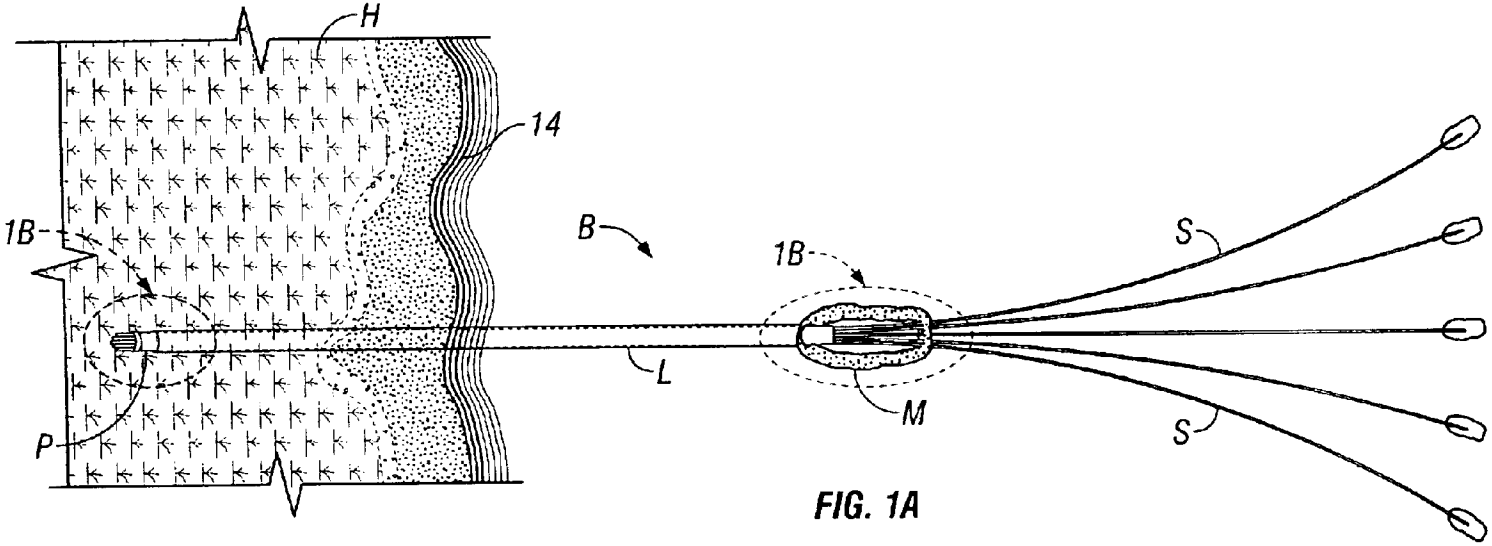
FIGS. 1A and 1B are respective plan views of a shore, a large diameter casing extending through the surf zone and into the maritime zone, and indicating schematically the "fan" type array of individual optical fiber cables trenched through the maritime zone for conventional placement to their respective destinations.
Figure 1B:
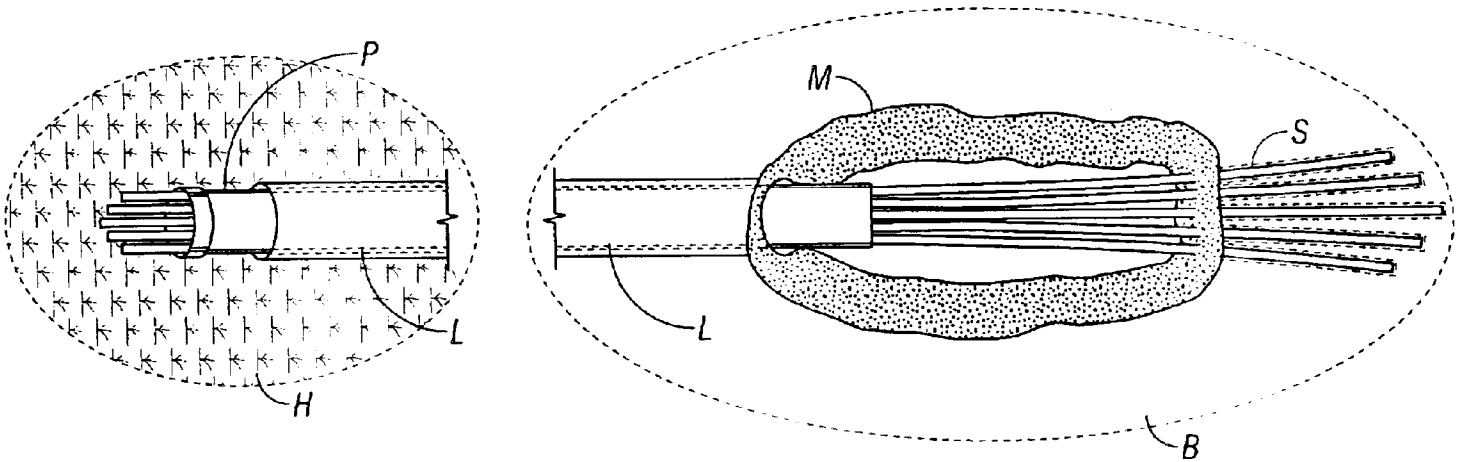

Referring to FIGS. 1A and 1B, large conduit L is shown leading from shore drill pit P to maritime exit pit M. Large conduit L extends from shore H to ocean bottom B exiting from an otherwise subterranean disposition along the ocean bottom exit at maritime exit pit M.

Large conduit L is threaded with a multiplicity of small cables S. Typically, small cables S are either trenched into ocean bottom B or alternatively are just "laid" along the ocean bottom B, once shore line 14 has been successfully traversed. Thus, FIGS. 1A and 1B depict one desired end result of the apparatus and process here disclosed.

Figure 2A:
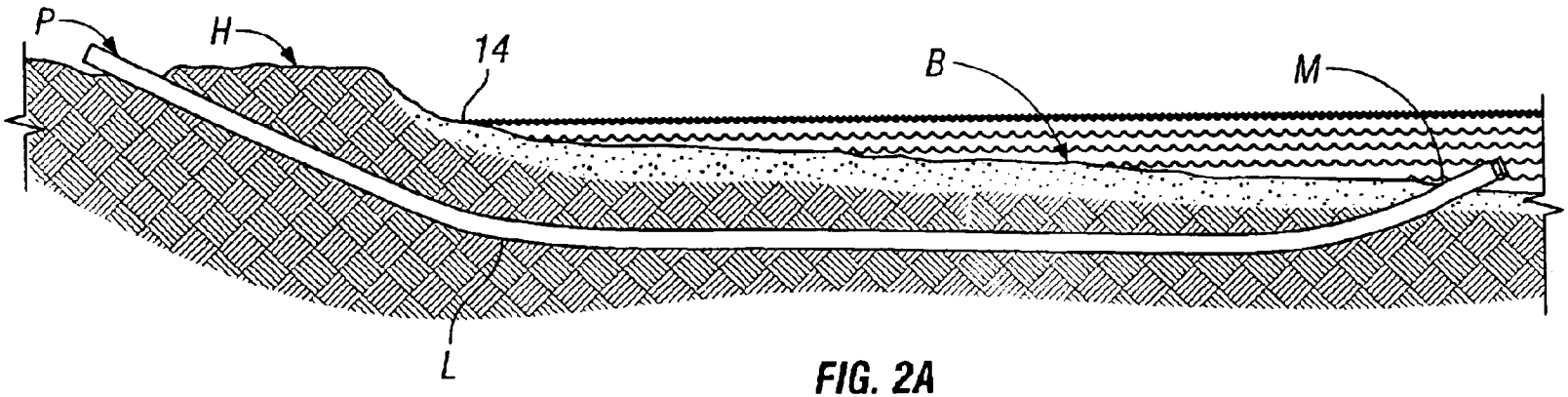
FIG. 2A is a side elevation section, broken away, illustrating the entry point of the large diameter bore, and the exit point of the large diameter bore.

FIG. 2A illustrates a first alternative of the final installation of the surf and maritime transition of this invention. In this embodiment, large conduit L makes the entire traverse of both shoreline 14 and ocean bottom B in the maritime zone. In this embodiment, small cables S (not yet shown) are then threaded and laid conventionally over the ocean bottom to their respective destinations.

The reader will understand the maritime exit pit M could just as well be at shore level on the opposite side of a body of water, such as a lake, river, or bayou. Further, the conduit ultimately placed does not necessarily have to contain cables; the conduit can be used for the transport of fluids, such as gas or oil.

Figure 2B:
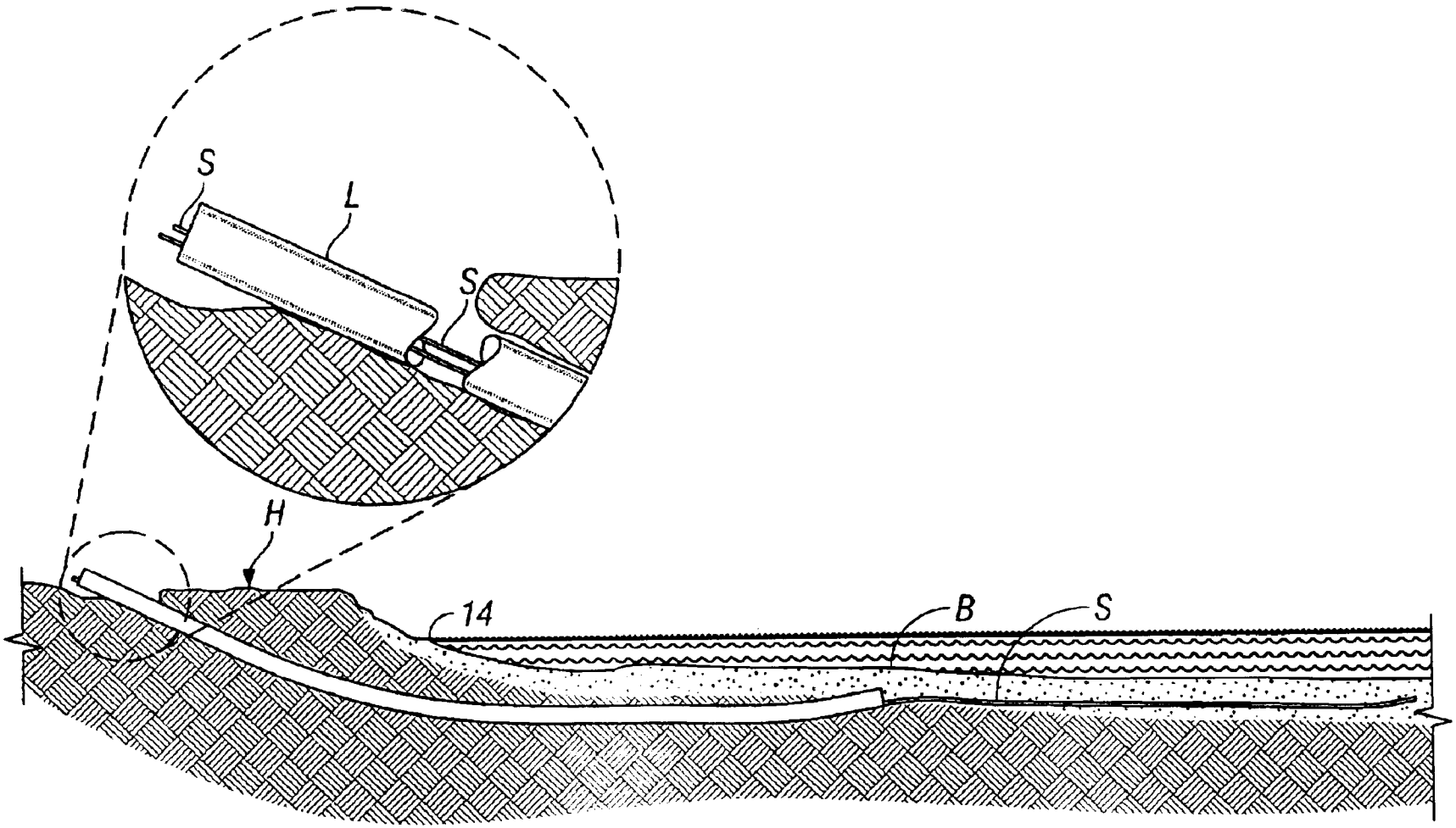
FIG. 2B is an alternative view of the casing of FIG. 2A here illustrating the cable fan array trenched into the ocean bottom.

FIG. 2B is an alternative embodiment. In this case, small cables S are conventionally trenched from the end of large conduit L. In the usual case this is done by introducing trenching at the maritime pit M and later filling in the maritime pit M when trenching is complete.

Figure 3C:
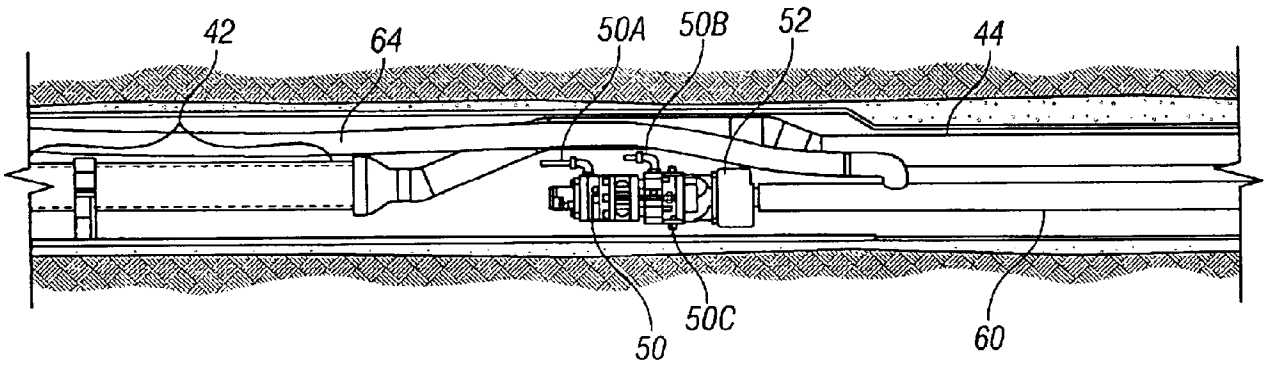

Referring to FIG. 3A, the main components of drill head D can be understood. Typically mud supply line 62 supplies mud under pressure to mud pump 60 (commonly a hydraulic positive displacement pump of the so-called "Moyno" variety). Rotary power obtained from exhaust mud hydraulic pump 60 drives hydraulic pumps 50 through gear box 52. The output of the respective hydraulic pumps 50 is electronically switched to drive the active components of the drill head H. Hydraulic circuit 50A powers drill bit 20 through thrust bearing 23. Hydraulic circuit 50B steers drill head H which is articulated with respect to the remainder of casing C. Hydraulic circuit 50C powers fluid return pump 42 to maintain the required pressure in annulus 22. For simplicity, the hydraulic circuits are only partially shown.

Exhaust mud from main mud motor 60 is channeled by mud exhaust line 64 to drill head 20 via mud swivel 65. (See FIG. 3B) There, the exhaust mud serves to entrain cuttings and pass the cuttings in an annulus 22 around drill head H. Steering of drill head H is provided by steering jacks 30.

Finally it is required that evacuation of drilling mud and cuttings occur. Exhaust mud hydraulic motor 40 drives exhaust mud hydraulic pump 42 (typically a hydraulic positive displacement pump of the Moyno variety). Utilizing this positive displacement pump, control of the pressure in annulus 22 about drill head H can be maintained. Return of drilling mud and tailings occurs through return mud line 44.

Specifically, in the embodiment illustrated, it will be remembered that drilling is occurring along a shore. Typically, such shores include frequent fracture zones and the like where mud from the annulus could easily exit. By controlling the rate of exhaust mud hydraulic mud pump motor 40, exhaust mud hydraulic pump 44 can be operated at a rate where a slightly negative pressure gradient is maintained between the ocean overlying ocean bottom B and annulus 22 about drill head H. This assures that any leakage will be from the ocean and to annulus 22, and not the opposite. Thus the disclosed apparatus assures that undesired leakage will not occur.

It will also be understood that pressure can be controlled from the point of mud evacuation to the entry pit on the shoreline. This pressure control will enable a flow of lubricating mud to pass along the annulus between the pipe in the geologic formation, assuring the lubricity of the pipe being placed.

Referring to FIG. 3E, it will be seen that exhaust mud hydraulic pump 42 has an entrance 46 directed to the bottom of drill head H. Pump 42 is operated at a rate where negative pressure can be maintained about annulus 22 of drill head H. The reader should understand that mud and tailings from drill bit 20 can contain solid particulate matter. Moreover, particulate can be gather from annulus 22. In such case, it is desired to be able to clear obstructions. Specifically, occasional reversal of exhaust mud hydraulic pump motor 40 will cause exhaust mud hydraulic pump 42 to reverse mud flow for clearance of such debris.

Figure 3D:
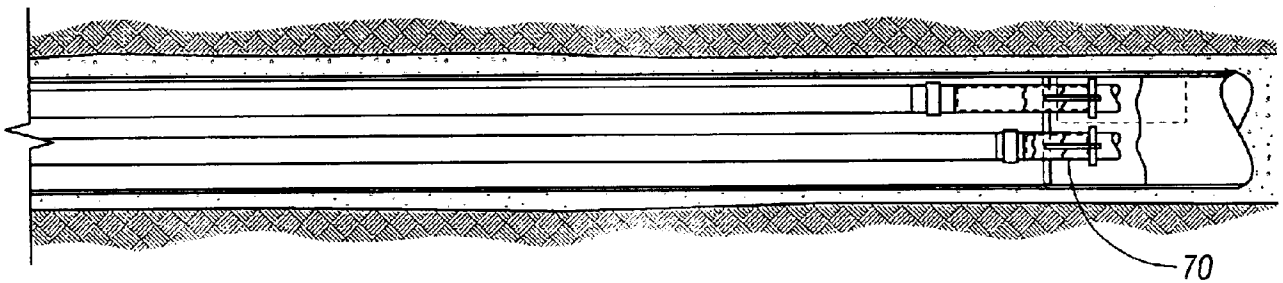

Finally, and referring to FIG. 3D, quick disconnects 70 are illustrated. The function of these quick disconnects 70 can be more fully understood with referenced to FIGS. 4A, 4B and 4C.

Specifically, when large conduit L had completed its subterranean pass of ocean bottom B, it is surfaced in maritime exit pit M. In the usual case, divers are dispatched and severance of drill head H from the leading edge of large conduit L occurs. Drill head H is then removed by conventional lifting lines 72.

Figure 4A:
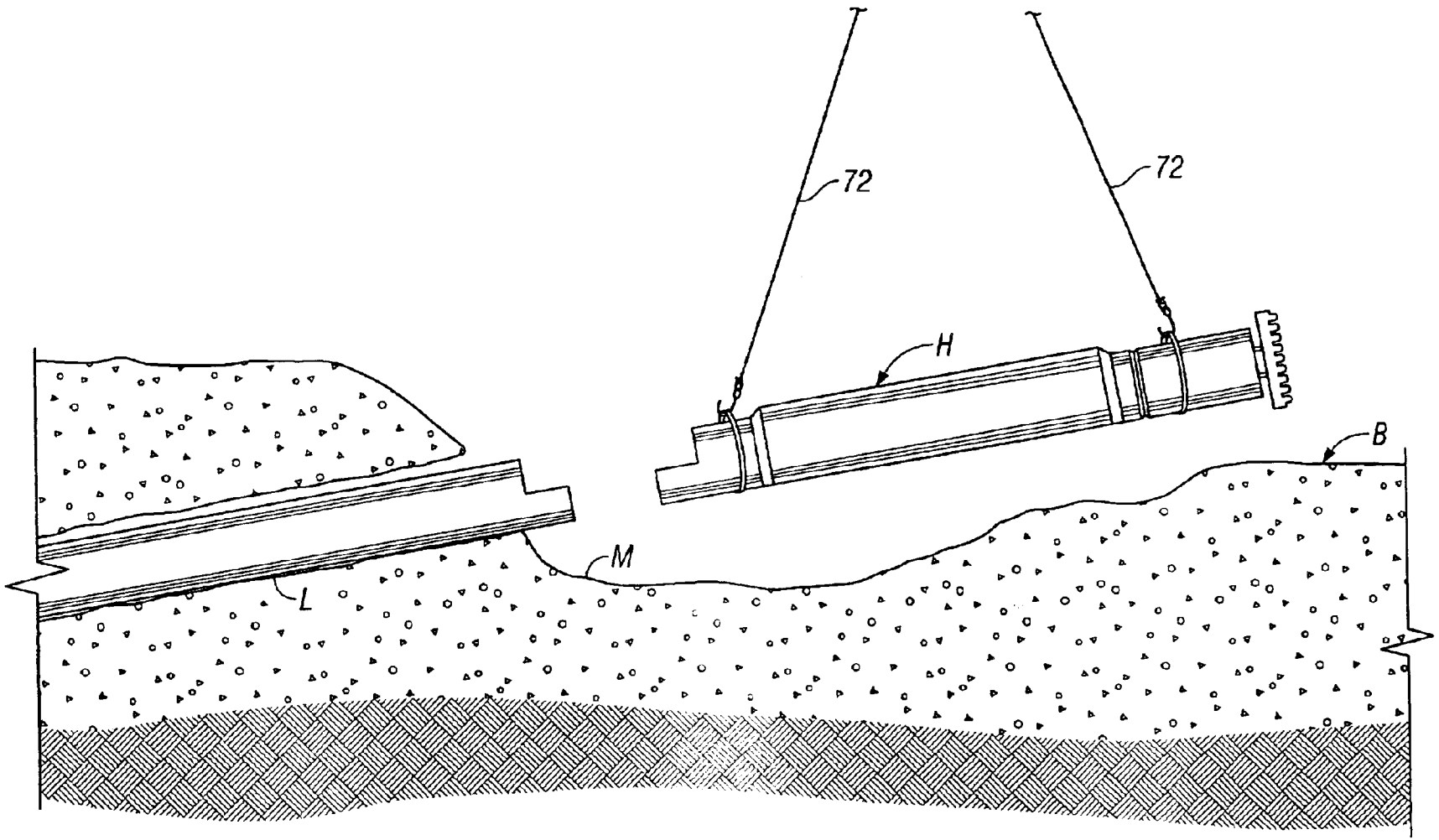
FIG. 4A illustrates the removal of the drill head and the underwater and underground exposure of the large diameter bore.

Unfortunately, there remains the more complex job of severing main mud supply line 62 and exhaust mud return conduit 44. For this reason, an access portion 74 is cut away overlying the connections of mud supply line 62 and exhaust mud return conduit 44 to the remainder of large conduit L. In FIG. 4A, it will be seen that disconnection of these respective two lines has already occurred, and drill head H is being removed.

Figure 4B:
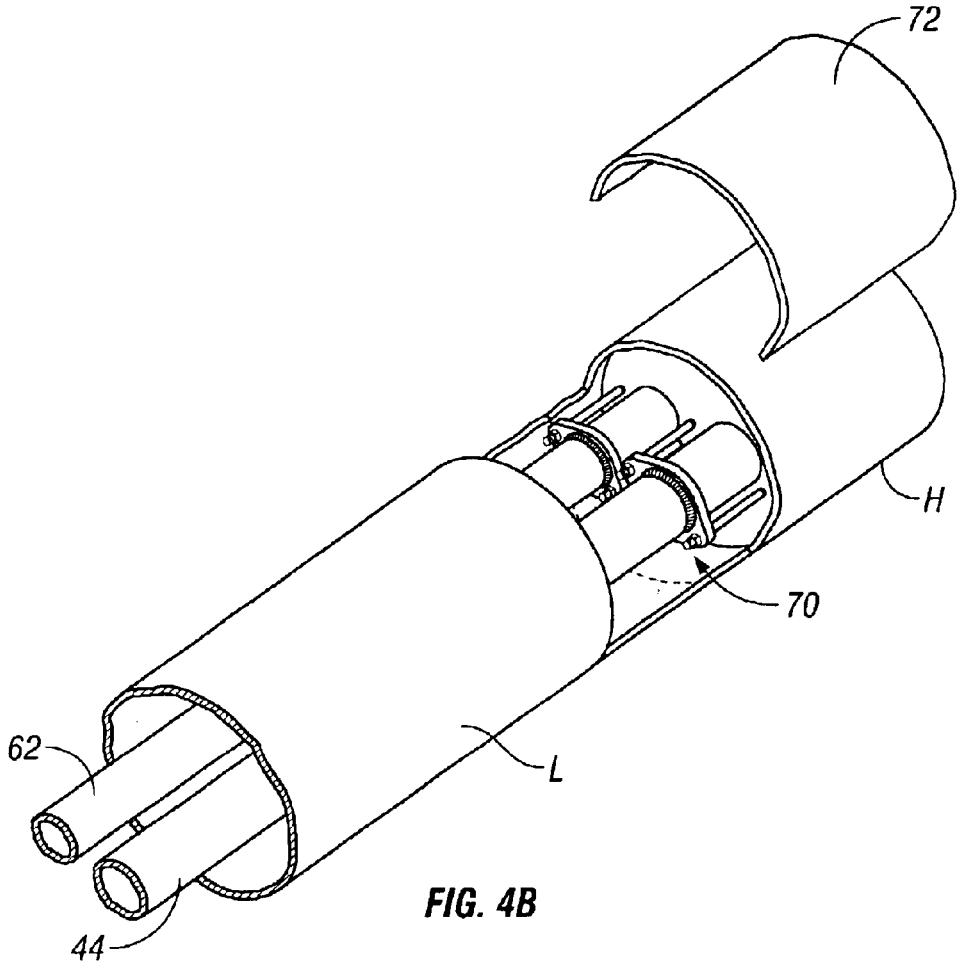
FIG. 4B illustrates the severable connection showing a large section of the conduit cut away and the underlying rapid disconnects utilized for first severing and then withdrawing the mud supply line and the mud evacuation line.
Figure 4C:
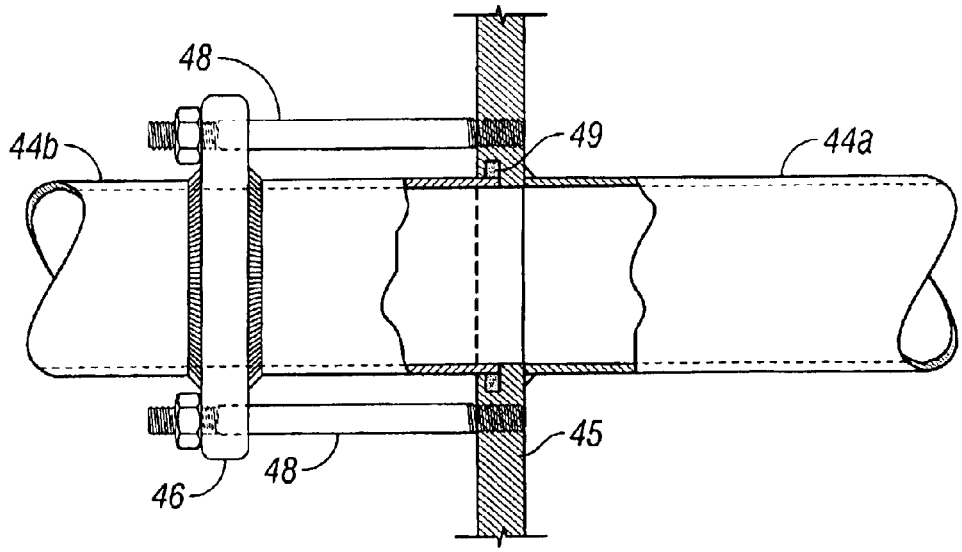
FIG. 4C is a detail at the end of the removable drill-string where it adjoins the remainder of the large conduit illustrating a detachable collection which can be utilized for first detaching and thereafter withdrawing the mud supply and mud evacuation lines; and, FIG. 5 discloses the threading of a single small diameter conduit through the large diameter conduit with conventional trenching occurring through the maritime zone out to the normal sea bottom where conventional cable placement can occur.

Referring to FIG. 4B, access panel 72 is shown cut away exposing quick disconnects 70 for diver access.

Assuming that access panel 74 is removed, disconnection of mud return conduit 44 is easily understood. Specifically, bulkhead 45 has attached bolts 48 leading to flange 46 on the end of mud return conduit 44. By release of bolts 48, flange 46 is released and mud return conduit 44 separated at packing 49. Thus, mud return line portion 44*a* will remain with drill head H and mud return line portion 44*b* will be pulled back through large conduit L and extracted at shore drill pit P. By repeating this process for main mud supply line 62, large conduit L will be both cleared of the respective lines and left in place.

Figure 5:
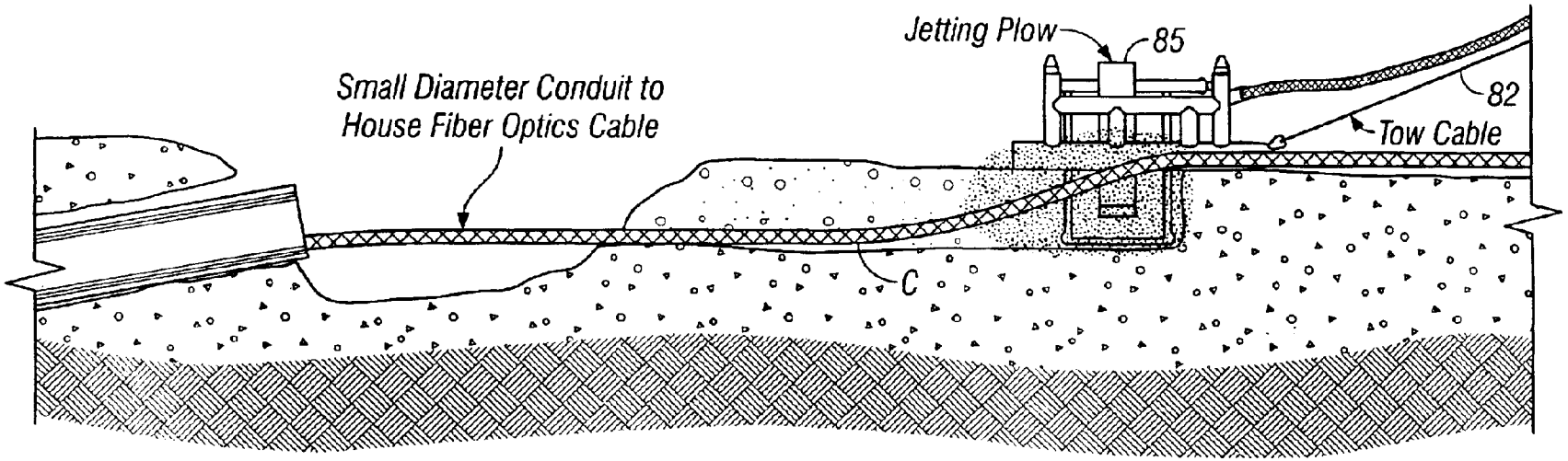

Referring to FIG. 5, conventional subterranean burying of small conventional cabling C in a sandy or muddy ocean bottom B is disclosed. Specifically, tow cable 82 pulls conventional jetting plow 85 from maritime pit M. Small cable C is fed to jetting plow 85 to sufficient bury the cable to avoid most conventional ocean bottom B hazards such as ground tackle from shipping and the like. It will be appreciated that while jetting plow 85 is conventional, pulling and burying small cable C in a fan like array as shown in FIG. 1A is novel with this disclosure.

The electronic controls necessary for the implementation of this invention are not shown as they are well within ordinary skill in the electronic arts.

It will be understood that this disclosure provides for the drilling of a large diameter conduit in either arcuate or straight configuration. Further, the ability to control the pressure of the mud in the annulus around the place pipe can assure a flow of drilling mud to maintain the required lubricity for advancement of the large diameter pipe as drilling occurs.

It must further be understood that the combination of conduits selected must be sufficient to maintain negative buoyancy of the drill head and pipe with respect to the surrounding geological formation and hydrostatic head. This is to avoid abrasion or removal of portions of the formation overlying the drill pipe. If the drill the pipe is allowed to acquire positive buoyancy, it could abrade and remove portions of the overlying formation, either facilitating polluting leakage or alternatively exposing the drill conduit.

I illustrate here the use of a single mud supply line. Obviously, multiple mud supply lines may be utilized. For example, one mud supply line can be used to provide the requisite lubricated environment at the cutting head. The remaining mud supply line can be used to drive the hydraulics and generally function in the manner of the single supply line illustrated herein.

Further, it is possible to dedicate a fluid circuit for powering of the hydraulics. In this case, drilling mud or some other fluid, can be supplied to drive the hydraulics and return interior of the installed conduit without being exposed to either the cutting head or tailings from the cutting head.

It will be understood that the operating electronics can include placed gauges to read the axial amount of force of the drilling pit on the formation, to read the annulus mud density, and to read the annulus mud pressure.

What is claimed is:

1. In a large diameter drill for placing a corresponding large diameter casing, the combination comprising:

a large diameter drill head including a stationary casing attached to the leading end of the large diameter casing, an articulating portion for steering the drill head; a pump for evacuating drilling mud and tailings, and a rotating cutting head;

a large diameter casing attached to the large diameter drill head;

a drilling mud supply line for supplying drilling mud under pressure to the drilling head threaded through the large diameter casing;

a drilling mud removal line for receiving exhausted drilling mud and tailings and removing the exhausted drilling mud and tailings from the drilling head threaded through the large diameter casing;

a mud driven motor in the vicinity of the large diameter drill head for receiving drilling mud under pressure and providing a rotational output, the mud driven motor having exhaust at least to the rotating cutting head;

at least one hydraulic driven pump for receiving the rotational output from the mud driven motor and providing pressurized hydraulic output through a control manifold to a plurality of closed loop hydraulic circuits contained in the cutting head;

a remote connect between the manifold and the plurality of hydraulic circuits for individually controlling the rate of hydraulic fluid flow to the hydraulic circuits;

at least one hydraulic circuit connected to the rotating cutting head for rotating the cutting head at a variable and controlled speed;

at least one hydraulic circuit connected to the pump for the evacuation of the drilling mud and tailings for operating the pump for drilling mud and tailings at a variable and controlled rate, the pump for the evacuation of drilling mud and tailing connected to the drilling mud removal line;

at least one hydraulic circuit connected to articulating portion of the drill head for the controlled varying of the articulating portion for steering the drill head for steering the drill head.

2. In a large diameter drill for placing a corresponding large diameter casing according to claim 1, the combination further comprising:

the pump for evacuating drilling mud and tailings is variable speed pump.

3. In a large diameter drill for placing a corresponding large diameter casing according to claim 1, the combination further comprising:

the pump for evacuating drilling mud and tailings is a positive displacement pump.

4. In a large diameter drill for placing a corresponding large diameter casing according to claim 1, the combination further comprising:

the pump for evacuating drilling mud and tailings is a positive displacement Moyno pump.

5. A process for drilling a large diameter bore from a entry point through a formation having numerous fractures in a formation permitting the escape of drilling mud, the process comprising the steps of:

providing a large diameter drill head including a stationary casing attached to the leading end of the large diameter casing, an articulating portion for steering the drill head; a pump for evacuating drilling mud and tailings, and a rotating cutting head;

providing a large diameter casing attached to the large diameter drill head;

providing a drilling mud supply line for supplying drilling mud under pressure to the drilling head threaded through the large diameter casing;

providing a drilling mud removal line for receiving exhausted drilling mud and tailings and removing the exhausted drilling mud and tailings from the drilling head threaded through the large diameter casing;

providing a mud driven motor in the vicinity of the large diameter drill head for receiving drilling mud under pressure and providing a rotational output, the mud driven motor having exhaust at least to the rotating cutting head;

providing at least one hydraulic driven pump for receiving the rotational output from the hydraulic motor and providing pressurized hydraulic output to a plurality of closed loop hydraulic circuits contained in the cutting head;

supplying drilling mud to power the mud driven motor;

providing a remote connect between the manifold and the plurality of hydraulic circuits for individually controlling the rate of hydraulic fluid flow to the hydraulic circuits;

controlling at least one hydraulic circuit connected to the rotating cutting head for rotating the cutting head at a variable and controlled speed;

controlling at least one hydraulic circuit connected to the pump for the evacuation of the drilling mud and tailings for operating the pump for drilling mud and tailings at a variable and controlled rate, the pump for the evacuation of drilling mud and tailing connected to the drilling mud removal line; and, controlling at least one hydraulic circuit connected to articulating portion of the drill head for the controlled varying of the articulating portion for steering the drill head for steering the drill head.

6. A process for drilling a large diameter bore from a entry point through a formation having numerous fractures in a formation permitting the escape of drilling mud, the process comprising the steps of:

providing a large diameter drill head including a stationary casing attached to the leading end of the large diameter casing, an articulating portion for steering the drill head; a pump for evacuating drilling mud and tailings, and a rotating cutting head;

providing a large diameter casing attached to the large diameter drill head;

providing a drilling mud supply line for supplying drilling mud under pressure to the drilling head threaded through the large diameter casing;

providing a drilling mud removal line for receiving exhausted drilling mud and tailings and removing the exhausted drilling mud and tailings from the drilling head threaded through the large diameter casing;

providing a mud driven motor in the vicinity of the large diameter drill head for receiving drilling mud under pressure and providing a rotational output, the mud driven motor having exhaust at least to the rotating cutting head;

providing at least one hydraulic driven pump for receiving the rotational output from the hydraulic motor and providing pressurized hydraulic output through a control manifold to a plurality of closed loop hydraulic circuits contained in the cutting head;

supplying drilling mud through the drilling mud supply line to power the mud driven motor;

providing a remote connect between the manifold and the plurality of hydraulic circuits for individually controlling the rate of hydraulic fluid flow to the hydraulic circuits;

controlling at least one hydraulic circuit connected to the pump for the evacuation of the drilling mud and tailings for operating the pump for drilling mud and tailings at a variable and controlled rate to maintain a negative pressure between the ambient ground around the drilling head and the pump for the evacuation of drilling mud and tailing connected to the drilling mud removal line whereby the drilling mud from the drilling head is inhibited from escaping.

* * * * *